United States Patent [19]

De Varennes

[11] Patent Number: 4,756,489

[45] Date of Patent: Jul. 12, 1988

[54] METHOD AND APPARATUS FOR GUIDING FILAMENTARY MATERIAL ONTO A REEL

[75] Inventor: Joseph G. C. C. De Varennes, Montreal, Canada

[73] Assignee: Northern Telecom Limited, Montreal, Canada

[21] Appl. No.: 111,543

[22] Filed: Oct. 23, 1987

[51] Int. Cl.[4] ..... B65H 54/28; B65H 57/28

[52] U.S. Cl. ..... 242/158.2; 242/157 R; 242/158 R; 242/158.3

[58] Field of Search ..... 242/158.2, 158.3, 158.4 R, 242/158.4 A, 158 R, 158 B, 158 F, 158.1, 157, 157.1

[56] References Cited

U.S. PATENT DOCUMENTS

| | | | |
|---|---|---|---|
| 1,646,804 | 10/1927 | Westwood | 242/158.3 |
| 2,639,105 | 5/1953 | Farrar | 242/158.3 |
| 2,731,605 | 1/1956 | Doelz | 242/158.2 X |
| 2,757,883 | 8/1956 | Schlang et al. | 242/158.2 |
| 3,270,982 | 9/1966 | Prange | 242/158.3 |
| 3,552,682 | 1/1971 | Walsh | 242/158.3 |
| 3,948,462 | 4/1976 | Maillefer | 242/158.2 X |

*Primary Examiner*—Stanley N. Gilreath

[57] ABSTRACT

In a method and apparatus for guiding a cable core as it is wound onto a reel, a pair of opposed guide pulleys, which are driven reciprocally parallel to the rotation axis of the reel, are mounted for free translational motion in a direction perpendicular to the direction of reciprocal motion, for free pivotal motion about a pivotal axis parallel to the direction of reciprocal motion, and for free pivotal motion about a pivotal axis perpendicular to the direction of reciprocal motion. This mounting arrangement permits the guide pulleys to assume a position and orientation which minimizes bending of the cable core as it passes between the pulleys, reducing flattening of the cable core during the reeling operation.

12 Claims, 3 Drawing Sheets

METHOD AND APPARATUS FOR GUIDING FILAMENTARY MATERIAL ONTO A REEL

The present invention relates to a method and apparatus for guiding filamentary material onto a reel.

It is known to provide a pair of opposed filament guide rollers which move reciprocally in a direction parallel to the rotational axis of a reel to guide filamentary material between the rollers and onto the reel as the reel is rotated to wind the filamentary material onto the reel. Such a filament guide permits winding of successive layers of filamentary material onto the reel, the filamentary material moving progressively along the axis of the rollers as successive layers are wound onto the reel. Passage of the filamentary material under tension between the rollers can cause flattening of the filamentary material, particularly if the filamentary material is readily crushed. For example, telecommunications core assemblies comprising a plurality of insulated conductors stranded together to form a composite filament of essentially circular cross-section, are often distorted into an oval cross-section as they pass between such rollers during a reeling operation.

The present invention seeks to provide apparatus for guiding filamentary material onto a reel which reduces distortion of the filamentary material.

This apparatus includes, a frame and means for driving the frame into reciprocal motion in a direction substantially parallel to a rotational axis of the reel. A guide support is movably mounted to the frame for movement in a direction transverse to the reciprocal motion of the frame and transverse to a passline for the filamentary material.

A pair of opposed guide pulleys are mounted to a support for rotation in a common plane. Each pulley has a circumferential guide surface which is contoured so as to be complementary to a surface region of the filamentary material. A space is provided between the pulleys for passage of the filamentary material along the passline between the pulleys.

Because the guide pulleys have circumferential guide surfaces which are complementary to surface regions of the filamentary material, they do not tend to distort the filamentary material as it is drawn under tension between the pulleys.

Moreover, because the guide pulleys are free to move on the frame in a direction perpendicular to the direction of reciprocal motion, they can adopt a position which minimizes the change in direction of the filamentary material as it passes between the guide pulleys. In particular, as successive layers of filamentary material are wound on the reel the guide pulleys may move progressively in a direction transverse to the rotational axis of the reel. This movement reduces bending of the filamentary material at the guide pulleys, thereby further reducing distortion of the filamentary material.

Where the rotational axis of the reel is substantially horizontal, the guide pulleys may be mounted for movement on the frame in a substantially vertical direction. It is advantageous in this case to support the weight of the guide pulleys and guide support with a spring, for example a constant force spring, as this ensures that the guide pulleys are free to "float" to a position in which bending of the filamentary material is minimized.

Advantageously, the guide support is mounted to a linear slide bearing for movement on the frame. Pivotally mounting the support to the slide bearing for pivotal movement about an axis substantially parallel to the first direction, and for pivotal movement about an axis substantially perpendicular to the first direction permits the pulleys to change orientation as their position is changed. Consequently, the pulleys are free at each position of the support to adopt an orientation which minimizes the change in direction of the filamentary material for that position of the support.

An embodiment of the invention will now be described, by way of example only, with reference to the accompanying drawings, in which.

Figure 1:
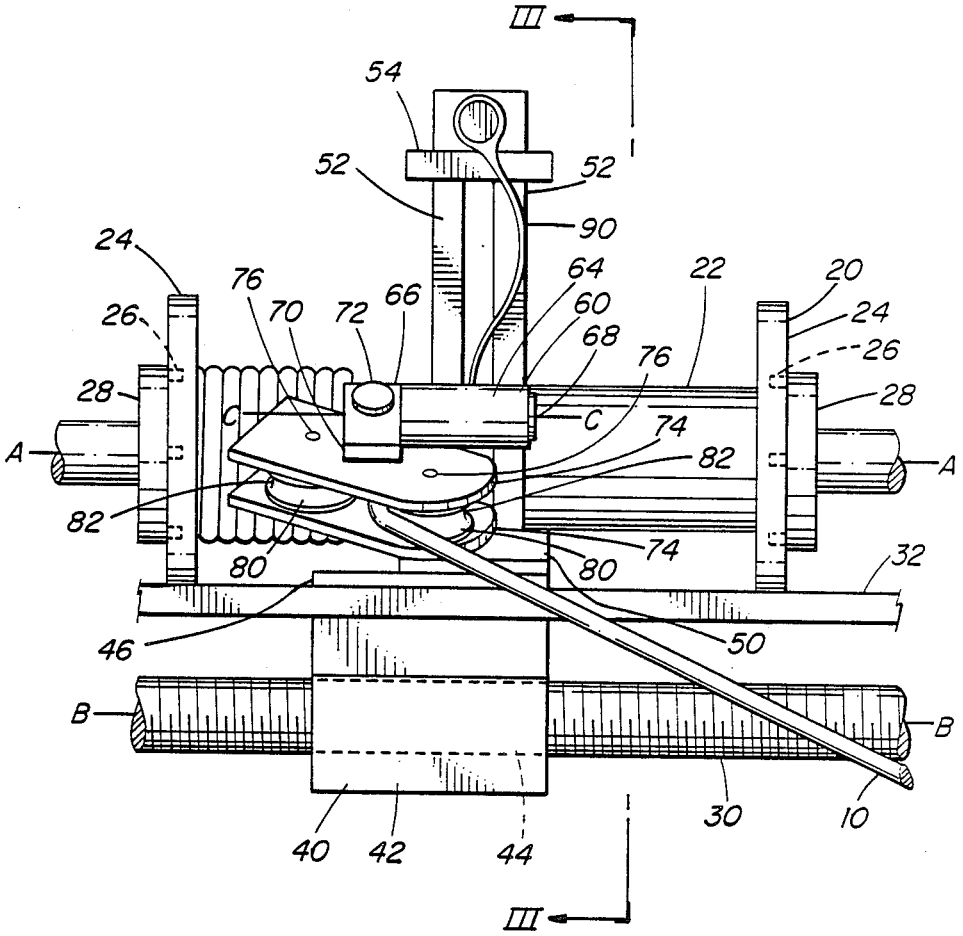
FIG. 1 is a front elevational view of apparatus for winding a cable core onto a reel according to the embodiment.
Figure 2:
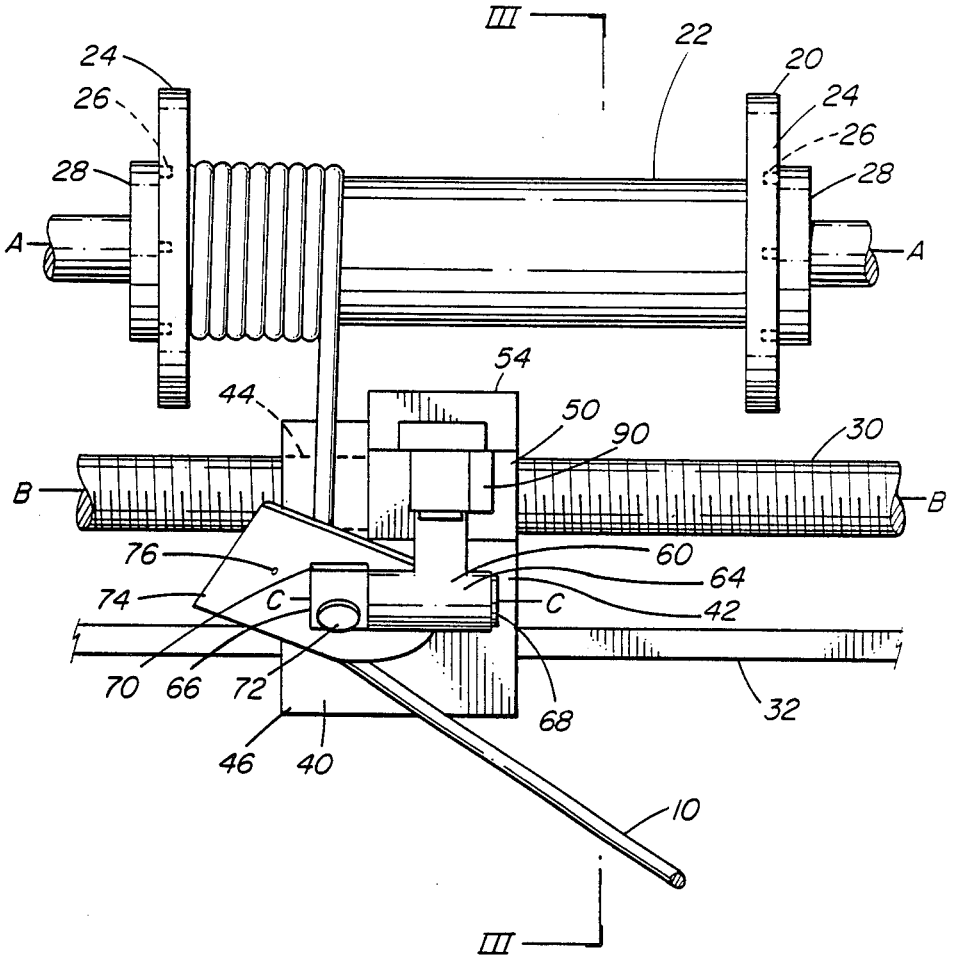
FIG. 2 is a top plan view of the apparatus of FIG. 1.
Figure 3:
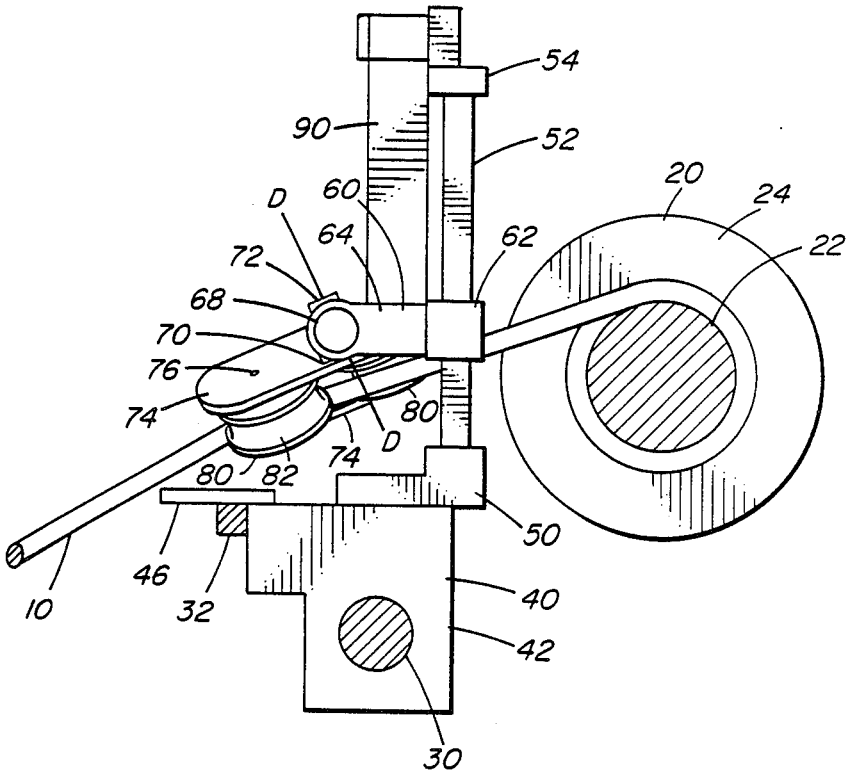
FIG. 3 is a cross-sectional view of the apparatus of FIGS. 1 and 2 taken on section line III—III of FIGS. 1 and 2.

FIGS. 1, 2 and 3 show apparatus for winding a telecommunications cable core 10 onto a reel 20. The cable core 10 comprises a plurality of insulated conductors stranded together to form a composite filament of essentially circular cross-section. Such cable cores are easily distorted into an oval cross-section during conventional reeling operations, particularly where the cable cores are drawn under tension between opposed guide rollers.

The reel 20 comprises a central spindle 22 and two flanges 24, each at a respective end of the spindle. The flanges 24 are provided with circumferentially spaced openings 26 which receive complementary projections of drive wheels 28. The drive wheels 28 are operable connected to an electric motor (not shown) for rotation of the reel 20 about its rotational axis A—A.

A threaded shaft 30 extends along an axis B—B which is parallel to and forward of the rotational axis A—A of the reel 20. The threaded shaft 30 is operably connected to an electric motor (not shown) for rotation of the shaft 30 about axis B—B alternately in opposite senses. A rail 32 extends parallel to the shaft 30.

The threaded shaft 30 and rail 32 support a frame 40 comprising a platform 42 having a threaded passage 44 which receives the threaded shaft, and a step 46 overhanging a front end of the platform which rests on and slidably engages the rail 32.

The frame 40 further comprises a block 50 overhanging a rear end of the platform. The block 50 supports a pair of laterally spaced upright rods 52 which are joined at upper ends of the rods by a cross-piece 54.

A guide support 60 comprises a first guide support part in the form of linear slide bearings 62 mounted for vertical sliding movement on the upright rods 52 and a first body 64 fixed to the slide bearings, and a second guide support part in the form of a second body 66 pivotally mounted to the first body by means of a horizontal pin 68 to pivot about a horizontal axis C—C, and a third body comprising a member 70 pivotally mounted to the second body by means of a pin 72 to pivot about an axis D—D which is perpendicular to the axis C—C. The third body further comprises a pair of parallel plates 74, the uppermost of which is fixed to the member 70, and the lowermost of which is fixed to the uppermost by pins 76.

The guide support 60 carries guide means in the form of a pair of opposed pulleys 80 mounted for rotation in a common plane between the plates 74, one pulley on each pin 76. A space is provided between the pulleys 80 for passage of the cable core 10 therebetween, and each pulley has a circumferential guide surface 82 which has concave contours complementary to the circular outer surface of the cable core.

The first body 64 of the guide support 60 is connected to the cross-piece 54 by a constant force spring 90 which deforms as the guide support moves vertically on the rods 52. The spring 90 is biased to exert an upward force on the guide support 60 which is equal to the weight of the guide support 60 and guide pulleys 80 combined, so that the guide support and pulleys "float" on the linear slide bearings 62.

In use of the apparatus, the cable core 10 is threaded along a passline between the guide pulleys 80 and secured to the reel spindle 22. As the reel 20 is driven into rotation to wind the cable core 10 onto the spindle 22, the threaded shaft 30 is driven to rotate alternately in opposite senses so as to drive the frame 40 reciprocally along the shaft from one end of the spindle to the other. The frame 40 carries the guide pulleys 80 which direct the cable core 10 to the reel 20, the reciprocal movement of the frame and pulleys causing successive layers of cable core to be wound onto the reel.

As the frame 40 moves along the shaft 30, the guide support 60 is free to pivot about the axis D—D to adopt an orientation which minimizes bending of the cable core 10 in a substantially horizontal plane.

As successive layers of cable core 10 are wound onto the reel, the guide support 60 is free to move upward on the slide bearings 62 and the guide support is free to pivot about the axis C—C to adopt a position and orientation which minimizes bending of the cable core in a vertical plane.

Consequently, the mounting of the guide support 60 minimizes overall bending of the cable core 10 as it is wound onto the reel 20, thereby reducing distortion due to excessive bending. Moreover, because the guide pulleys 80 are contoured to match the outer surface of the cable core, flattening of the cable core as it is drawn under tension between the pulleys is further reduced.

In alternative embodiments, the linear slide bearings 62 could be replaced by nylon or bronze bushings mounted for sliding movement on the upright rods 52.

What is claimed is:

1. Apparatus for drawing filamentary material along a passline onto a reel, comprising:

means for rotating a reel about an axis;

a frame;

means for driving the frame into reciprocal motion in a first direction substantially parallel to the rotational axis of the reel;

a guide support comprising a first guide support part movably mountd to the frame for movement in a second direction transverse to the first direction and transverse to the passline and a second guide support part pivotally mounted to the first guide support part for pivotal movement about an axis substantially parallel to the first direction; and a pair of opposed guide pulleys rotatably mounted in a common plane to the second guide support part, each of the guide pulleys having a circumferential guide surface which is contoured so as to be complementary to a surface region of the filamentary material.

2. Apparatus as defined in claim 1, wherein the first guide support part comprises a linear slide bearing mounted to the frame for sliding movement in the second direction on the frame and a first body fixed to the linear slide bearing, and the second guide part is pivotally mounted to the first body.

3. Apparatus as defined in claim 2, wherein the second guide support part comprises a second body pivotally mounted to the first body for pivotal movement about an axis substantially parallel to said first direction and a third body pivotally mounted to the second body for pivotal movement about an axis substantially perpendicular to the first direction, and the guide pulleys are rotatably mounted to the third body.

4. Apparatus as defined in claim 1, wherein said second direction is substantially vertical, and weight of the guide pulleys and guide support is supported by a spring.

5. Apparatus as defined in claim 4, wherein the spring is a constant force spring biased so as to exert an upward force on the guide support, the upward force being substantially equal to the combined weight of the guide pulleys and guide support.

6. Apparatus for guiding filamentary material as it is drawn along a passline onto a reel, the apparatus comprising:

a frame;

means for driving the frame into reciprocal motion in a first direction;

a guide support comprising a first guide support part movably mounted to the frame for movement in a second direction transverse to the first direction and transverse to the passline and a second guide support part pivotally mounted to the first guide support part for pivotal movement about an axis substantially parallel to the first direction; and a pair of opposed guide pulleys rotatably mounted in a common plane to the second guide support part, each pulley having a circumferential guide surface which is contoured so as to be complementary to a surface region of the filamentary material.

7. Apparatus as defined in claim 6, wherein the first guide support part comprises a linear slide bearing mounted to the frame for sliding movement in said first direction on the frame and a first body fixed to the linear slide bearing, and the second guide support part is pivotally mounted to the first body.

8. Apparatus as defined in claim 7, wherein the second guide support part comprises a second body pivotally mounted to the first body for pivotal movement about an axis substantially parallel to said first direction and a third body pivotally mounted to the second body for pivotal movement about an axis substantially perpendicular to the first direction, and the guide pulleys are rotatably mounted to the third body.

9. Apparatus as defined in claim 6, wherein said second direction is substantially vertical, and weight of the guide pulleys and guide support is supported by a spring.

10. Apparatus as defined in claim 9, wherein the spring is a constant force spring biased so as to exert an upward force on the guide support, the upward force being substantially equal to the combined weight of the guide pulleys and guide support.

11. A method for winding filamentary material onto a spindle, comprising:

passing a free end of a piece of filamentary material along a passline between a pair of guide pulleys having opposed circumferential guide surfaces which are complementary to surface regions of the filamentary material;

securing the free end to the spindle; and rotating the spindle about an axis of rotation to draw the filamentary material along the passline between the guide pulleys and onto the spindle while reciprocally moving the guide pulleys in a direction substantially parallel to said rotational axis from one end of the spindle to another to deposit successive layers of filamentary material on the spindle, while supporting the guide pulleys for free movement in a direction transverse to the direction of reciprocal movement and transverse to the passline and for free pivotal movement about an axis substantially parallel to the direction of reciprocal movement.

12. A method as defined in claim 11, further comprising supporting the guide pulleys for free pivotal movement about an axis substantially perpendicular to the direction of reciprocal movement.

* * * * *